United States Patent [19]

Sandberg et al.

[11] 4,142,385

[45] Mar. 6, 1979

[54] APPARATUS FOR WET PROCESSING TEXTILE MATERIAL

[75] Inventors: Sven Olof Sandberg; Sven R. E. Smith, both of Avesta, Sweden

[73] Assignee: Avesta Jernverks AB, Avesta, Sweden

[21] Appl. No.: 673,419

[22] Filed: Apr. 5, 1976

Related U.S. Application Data

[63] Continuation-in-part of Ser. No. 457,097, Apr. 1, 1974, Pat. No. 3,952,558.

[30] Foreign Application Priority Data

Mar. 28, 1973 [SE] Sweden ..... 7304386

[51] Int. Cl.[2] ..... D06B 3/28

[52] U.S. Cl. ..... 68/178

[58] Field of Search ..... 68/177, 178, 184; 26/21; 8/152

[56] References Cited

U.S. PATENT DOCUMENTS

| | | | |
|---|---|---|---|
| 3,493,321 | 2/1970 | Inoue et al. | 68/177 |
| 3,659,438 | 5/1972 | Chiba et al. | 68/177 |
| 3,698,212 | 10/1972 | Ameling et al. | 68/178 |
| 3,718,012 | 2/1973 | Vinas | 68/177 X |
| 3,780,544 | 12/1973 | Turner et al. | 68/177 |
| 3,894,411 | 7/1975 | Stanway | 68/177 X |

*Primary Examiner*—Philip R. Coe

[57] ABSTRACT

An apparatus for wet processing textile material, of the kind in which the textile material is circulated in endless web form partly through a bath containing a treatment liquid by means of a jet nozzle located above the bath. A deflector surface is located behind the jet nozzle for deflecting the jet and the web carried thereby. Between the jet nozzle and the deflector surface there is a space free from any structure imposing any restricting or guiding action on the jet and the web carried thereby before reaching the deflector surface.

11 Claims, 7 Drawing Figures

APPARATUS FOR WET PROCESSING TEXTILE MATERIAL

This is a continuation-in-part application of co-pending application Ser. No. 457,097—Sandberg, et al, filed Apr. 1, 1974, and now U.S. Pat. No. 3,952,558.

The present invention relates to an apparatus for wet processing textile material of the kind in which the textile material is circulated in the form of an endless web along a closed path extending in part through a bath containing a treatment liquid. Means for circulating the textile material includes a jet nozzle extending substantially horizontally above the bath. The apparatus further includes means for supplying a portion of treatment liquid to the nozzle under pressure for producing a jet drawing the web in string form through the jet nozzle.

Apparatuses of this general kind are known before through e.g. U.S. Pat. No. 3,718,012, Vinas dated Feb., 1973 and U.S. Pat. No. 3,780,544— Turner et al dated Dec. 25, 1973. These prior apparatuses have the feature in common that the textile string is transported and guided immediately after the jet nozzle through a long guiding tube. At its end remote from the jet nozzle said tube has a bend guiding the web downwards in the direction to the bath. The guiding tube imposes on the web and the treatment liquid a restricting and guiding action considerably slowing down the treatment velocity. It may thus be calculated that if the initial velocity of the jet in the prior apparatuses is e.g. 900 m/minute, the web will circulate only with a velocity of 300 m/minute.

One object of the present invention is to improve an apparatus of the kind referred to, and particularly to speed up the velocity of treatment considerably as compared with the known machines.

According to the invention a deflector surface is located after the nozzle outlet for deflecting the jet and the web carried thereby before reaching the bath. The nozzle outlet and the deflector surface are separated by a space free from any structure imposing any restricting or guiding action on the jet and the web carried thereby before they reach the deflector surface.

Due to the fact that the jet and the web move through a free space between the nozzle and the deflector surface, the retardation of the jet and the textile string is very small between the nozzle and the deflected surface.

Preferably the apparatus according to the invention is of the kind comprising an essentially U-shaped perforated guiding structure within which the endless web is circulated through the bath and that has legs located partially above the bath, the jet nozzle being located in a plane containing the legs. The jet nozzle outlet is located closer to the leg following after the nozzle outlet than to the leg preceding the nozzle. This implies generally that the distance between the deflector surface and the jet nozzle outlet is short thus allowing the jet and the web carried thereby to impinge very forcefully onto the deflector surface, which enhances the spreading out action on the textile web before it reaches the bath, as will be discussed more in detail hereinafter.

The invention furthermore reduces the overall dimensions of the apparatus as compared with earlier machines. Thus, the abovementioned closed path may be enclosed in its entirety within a cylindrical vessel, the cylinder axis of which extends transversely to said plane including the jet nozzle and the legs of the U-shaped guiding structure. The dimensions can be chosen such that the curvature of the U-shaped guiding structure conforms closely to the curvature of the cylinder.

Further features and advantages of the machine according to the invention will appear from the following description in detail of various embodiments thereof in conjunction with the accompanying drawings, in which.

Figure 3:
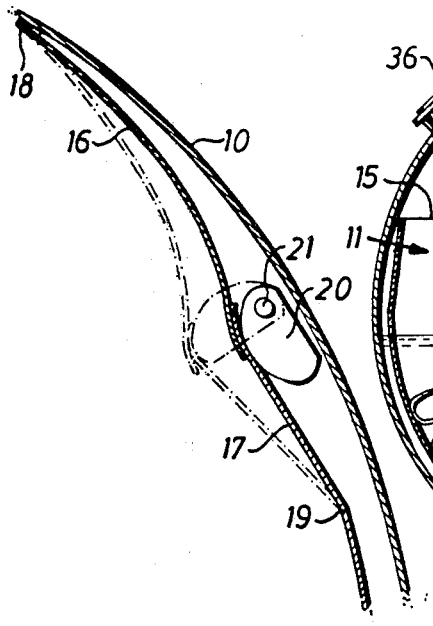
Figure 5:
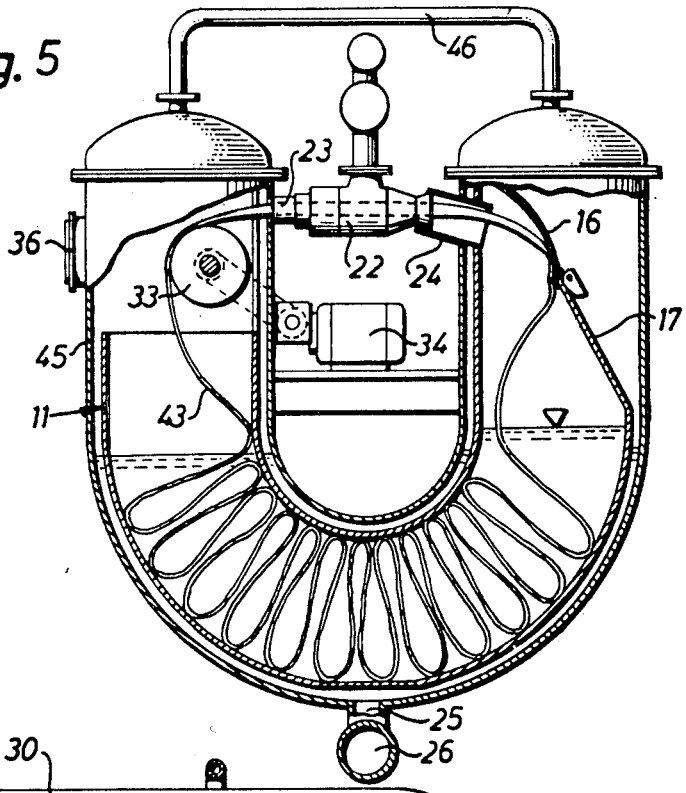
Figure 4:
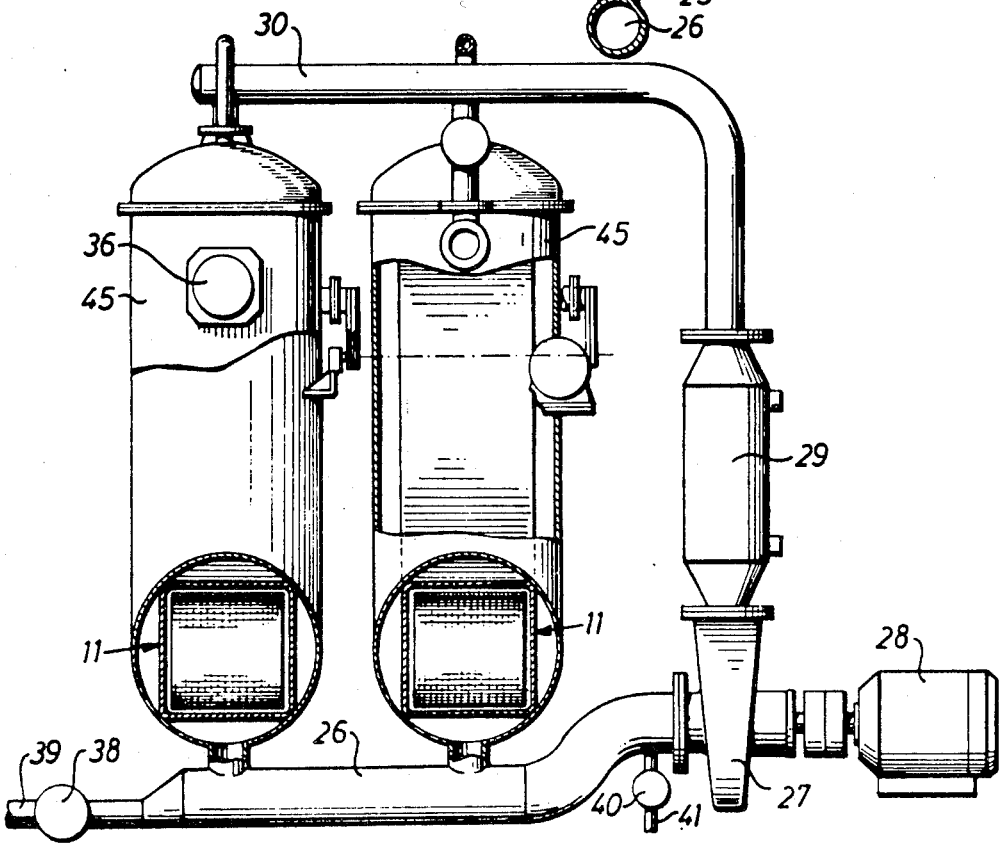
Figure 6:
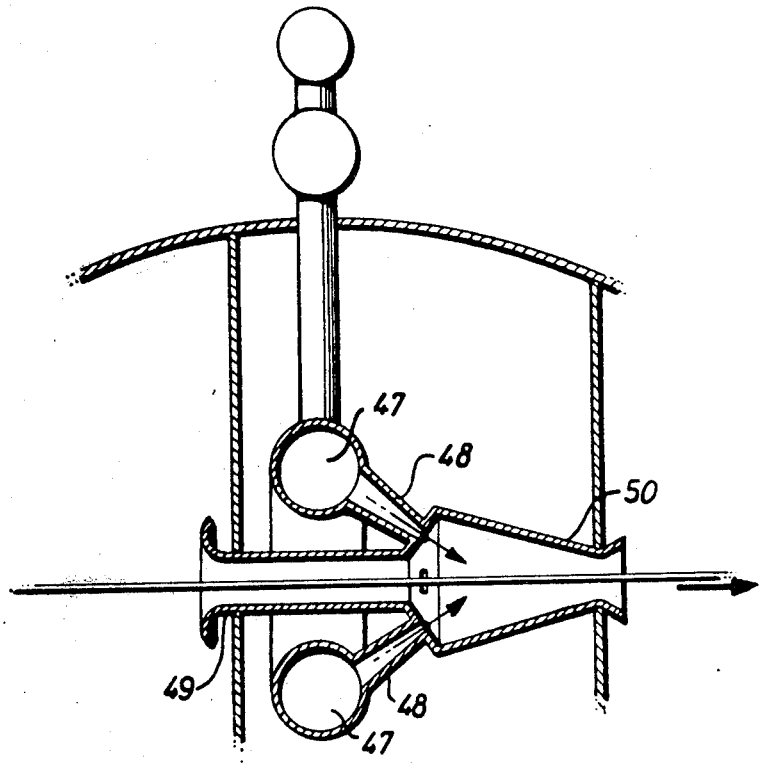

FIG. 3 on a larger scale, shows the system of adjustable guide-plates;

FIG. 4 is a side-view illustrating, with certain parts broken away, a second embodiment of the dyeing machine according to the invention;

FIG. 5 is an end-view of the dyeing machine according to FIG. 4 with certain parts broken away;

FIG. 6 shows an alternative constructional form of the driving nozzle; and

Figure 7:
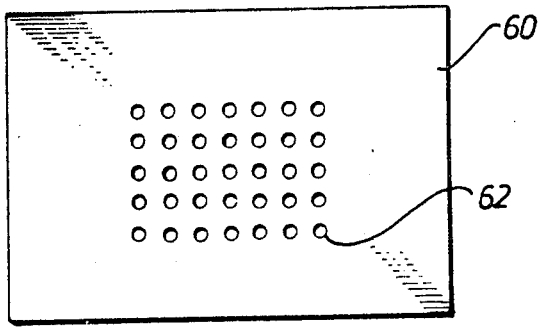

FIG. 7 shows an alternative constructional form of the guide plate.

Figure 2:
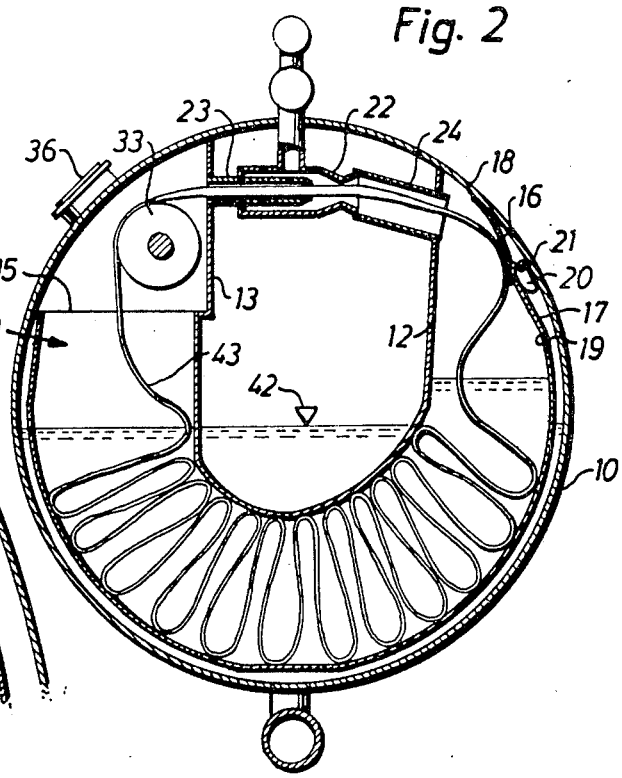
FIG. 2 is a cross-sectional view of the dyeing machine according to FIG. 1.
Figure 1:
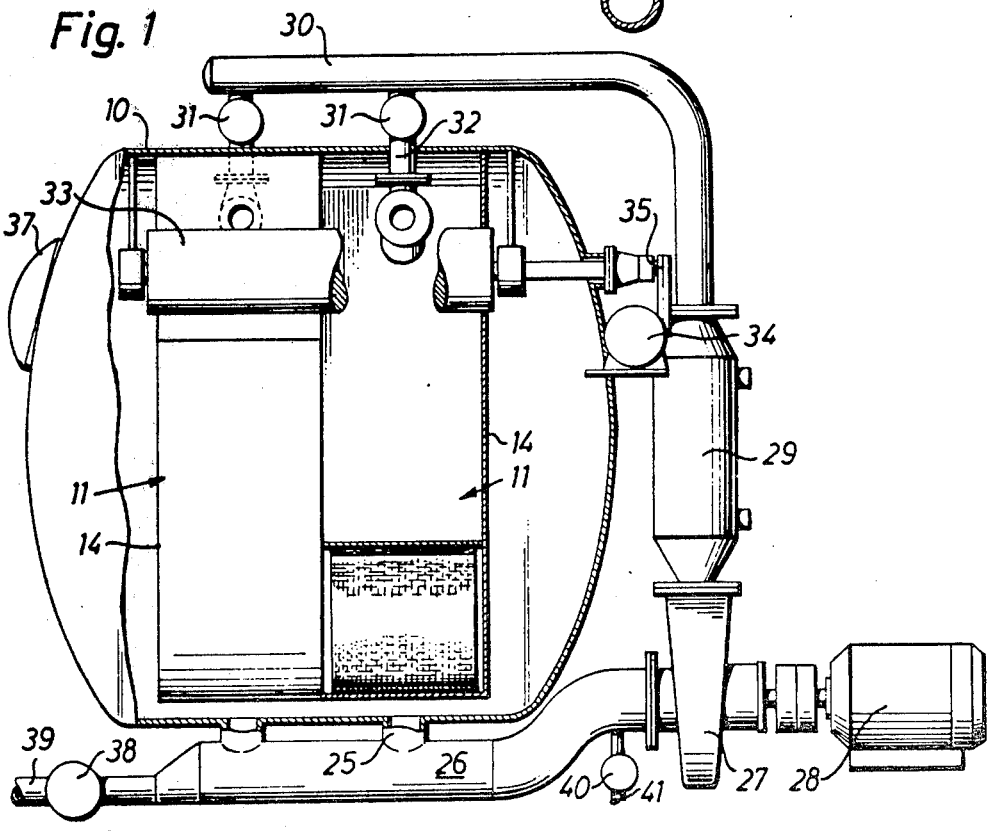
FIG. 1 is a side-view and partial vertical section of a first embodiment of a dyeing machine constructed in accordance with the invention.

In FIGS. 1 and 2, numeral 10 designates a closed container or vessel in the form of a horizontal cylinder with domed end walls. Suspended side by side within the container are two substantially U-shaped guiding boxes 11 for receiving the goods to be wet-treated. More particularly the legs of the U-shaped are, as is evident from the drawing, located essentially on each side of an imaginary plane. The radially inner boundary wall of the U-shaped boxes comprises, at the right-hand box leg, as seen in FIG. 2, a flat portion 12 extending vertically upward to the container ceiling, and comprises at the left-hand box leg, as seen in FIG. 2, a slightly offset wall portion 13 also extending vertically to the container ceiling. The vertically extending flat sidewalls 14 of the boxes, at the right-hand leg extend upward to the container ceiling, whereas, at the left-hand leg, they only extend upward to the level 15, the boxes thus being open at this end. The right hand box leg is sometimes referred to hereinafter as the inlet portion, and the left hand box leg as the outlet portion.

The radially outer boundary wall of the boxes 11, at the righthand leg extends with an inwardly curved portion thereof upwardly and into the angle between the container ceiling and the vertical wall portion 12. This inwardly curved upper wall portion is made up of two overlapping, concavely curved guide or deflector plates 16 and 17 being pivotable about upper and lower horizontally extending axes, 18 and 19, respectively, into different positions of adjustment by means of a cam 20 secured to a horizontally extending camshaft 21. As an alternative to this arrangement, the plates when subjected to adjustment could be resiliently deformed or flexed at their upper and lower ends, respectively.

Provided in the lower portions of the radially inner and outer boundary walls of the boxes 11 are a plurality of apertures through which the inner compartments of the boxes are in free communication with the liquid chamber outside the boxes. Each box 11 is sometimes referred to hereinafter as a U-shaped perforated guiding structure.

Secured centrally above each box 11 and between the vertical wall portions 13 and 12 is a substantially horizontally extending driving nozzle structure consisting of a constricted venturi nozzle 22 having an inlet tube 23 and after the nozzle outlet, a slightly downwardly inclined outlet tube 24. As is evident from the drawing, the nozzle outlet is located on the side of the above mentioned plane containing the right hand leg of the U-shape. The maximum inclination of the venturi nozzle structure should be suitably ±45° and preferably ±20° to the horizontal. The venturi nozzle structure is contained in a circulatory circuit for the treatment liquid comprising an outlet 25 from the container 10 beneath each box 11, an outlet manifold 26, a centrifugal pump 27 which is driven from an electric motor 28, a heat exchanger 29, a discharge pipe 30 from the latter, and two branched pipes 32 provided with respective control valves 31 and leading to the venturi nozzles, respectively. Mounted centrally above the outlet end of each box 11 is an in-feed drum or guide roller 33 which can be driven at a variable speed by an electric motor 34 through a bevel gearing 35.

Obliquely above the in-feed drum 33 and opposite each box 11, a loading opening is arranged in the peripheral wall of the container 10 and is normally closed by a cap 36. One end wall is provided with a manhole which is normally closed by a manhole cover 37.

The outlet or discharge manifold 26 can be connected to a discharge conduit 39 through a stop cock 38. Opening into the outlet manifold 26 near the pump 27 is a pipe 41 provided with a shut-off valve 40 and serving for introducing pigments into the machine from a metering or dispensing device, not shown.

The machine operates as follows:

After having supplied water or other liquid into the container 10 up to a level 42 such as to immerse the lower portions, at least, of the boxes 11 completely into the liquid, the machine is loaded with the web of fabric or any other textile material to be dyed or subjected to other wet-treatment. To accomplish this, after the pump 27 has been started and a forceful circulation of liquid through the venturi nozzles 22 has been initiated, then, after opening the cap 36, one end portion of the fabric web 43 is creased from both sides into a string or rope which is pushed through the inlet tube 23 and into the region of activity of the venturi nozzle 22. As soon as this region has been reached, the forceful jet of liquid will pull with it the fabric web which, after leaving the outlet tube 24, will drop down and successively fill the corresponding box 11. The outlet tube 24 thus serves as a means for preventing the web end leaving the nozzle from falling down into the vessel before reaching the right hand leg during this initial threading operation. The fabric web folded in the box will move slowly towards the discharge end of the box under the influence of gravity and of the liquid flowing through the box. At a suitable instant before the fabric web has been pulled completely through the venturi nozzle, the associated control valve 31 is closed, after which the operator will fish up the leading end of the fabric web lying in the box and will sew this end together with the trailing end of the web. Thus, the length of fabric to be dyed now is in the form of an endless web extending over the in-feed drum 33 in a closed path through the venturi nozzle 22 and the box 11 immersed in the liquid supply.

After closing the feed-in caps 36, the control valves 31 are reopened and adjusted to a degree such as to cause the respective textile webs 43 to be pulled through the venturi nozzles 22 at a speed which has been found to be suitable in view of the particular nature of the textile web. The liquid will leave the outlet tube 24 as a forceful jet in which the fabric web is embedded. The jet impinges the guide plate 16 at an acute angle and will become deflected downwardly by the guide plate, at the same time being flattened and spread out laterally, whereby the textile web is forced to convert from a rope- or string-like into a substantially band-like configuration. The textile band 43 is folded automatically, somewhat in the manner indicated in the drawing, on top of the material already folded within the box 11. The jet, because of the restriction of the venturi nozzle, as shown in FIG. 2, will converge at a point disposed a certain distance after the passage through tube 23 so as to attain, together with the textile web a minimum cross-sectional area within tube 24. After this point, the jet along with the fabric web will diverge or expand so as to attain a cross-sectional area which is greater than the cross the string form of the fabric web within tube 23, before they will impinge upon the guide surface. The expanded form of the web is sometimes referred to hereinafter as the "band" form. This arrangement has been found to be of advantage, and therefore there should preferably exist a certain minimum, but substantial distance between the venturi tube and the guide surface in order to attain this effect.

The tube 24 is short enough so that it by no means restricts or guides the jet and the web carried thereby. The space between the nozzle outlet and the deflector surface 16, 17 is thus free from any structure imposing any restricting or guiding action on the jet and the web carried thereby. The shape of the jet-web path extending from the nozzle outlet, at the beginning of the tube 24, to the deflector surface is thus determined solely by the velocity of the jet when leaving the nozzle outlet.

The continuous supply of liquid into the box 11 will cause the liquid level in the right-hand box leg, as seen in FIG. 1, to rise above the liquid level within the container 10, and in continuous operation the liquid will flow slowly through the box and out through the apertures in the outer and inner boundary walls of the box, thereby facilitating the gravitational passage of the folded material through the box.

Experiments made have shown that it is possible, in a machine constructed in accordance with FIGS. 1 and 2, to let the textile material circulate through the nozzle and liquid bath at a speed several times that which was possible to attain in previously known machines of a similar type, and thus without the necessity of increasing the pressure height of the pump. The speed can be selected to be as high as 600 to 700 meters per minute, to be compared with a maximum of about 200 meters per minute in prior-art machines. This involves that the dwell periods of the material within the respective boxes will be highly shortened. If the textile web is assumed to have a length of 300 meters, and the speed of propulsion through the driving nozzle is assumed to be 600 ms./min., then it will only take half a minute for a specific portion of the textile web to pass through the box 11 from the inlet to the outlet end. This will imply that the material will only during a very short period occupy the same position within the box, thereby avoiding creasing and thus non-uniform dyeing caused thereby.

Another advantage of the high speed resides in a diminishment of the temperature difference between the textile material and the treatment bath in the driving nozzle. A further advantage relating to dyeing is that the color distribution over the textile goods will be more uniform.

When a suitable feed speed through the venturi nozzles 22 has been reached and a satisfactory folding-down of the material into the box has been attained by proper adjustment of the guide plate 16, the cock 40 provided in the pipe from the metering of dispensing device is opened for supplying pigment matter to the water or other liquid within the container, thereby starting the dyeing operation proper. This operation is continued until the treatment with dyeing liquid has given the desired result.

The embodiment shown in FIGS. 4 and 5 mainly differs from that shown in FIGS. 1 and 2 merely by the fact that the cylindrical container common to a plurality of boxes 11 has been replaced by individual containers 45 for the respective boxes. The container 45 associated with each box 11 has the configuration of a U and is circular in cross section. The venturi nozzle 22 with its inlet tube 23 and outlet tube 24 is no longer disposed within the container, but extends outside the container, between the two legs thereof. Such arrangement, too, involves a low lifting height for the textile web from the outlet end of the box 11 to the feed-in drum or guide roller 33. Extending between the tops of the two legs of container 45 is a pressure equalizing pipe 46.

In the modified form of the driving nozzle as shown in FIG. 6, treatment liquid at high pressure is admitted into an annular chamber or manifold 47 from which a row of circumferentially spaced jet nozzles 48 converge inwardly. The forceful liquid jets from these nozzles will impinge the textile material fed in through the inlet tube 49 in a rope-like form and will force the textile rope with it out through the outlet tube 50 from which the treatment liquid is discharged in the form of a forceful free jet. The latter will be deflected downward when impinging an inclined guide surface, as described hereinbefore.

FIG. 7 illustrates the feature of providing the guide surface, here designated by 60, within the region of impingement of the liquid jet and the fabric web, with holes 62. Such design has been found to be particularly suitable for certain types of textile goods, owing to the fact that a portion of the liquid of the jet will thereby be deflected into the space existing between the container 10 and box 11 which will result in an improved spreading of the fabric string or rope laterally.

The invention, of course, is not restricted to the embodiments illustrated in the drawings and described in detail hereinbefore, since many modifications are conceivable without departing from the scope of the invention. In particular, the hydraulic driving nozzle may be of different design. The guide surface need not necessarily be provided by an adjustable guide member, but may instead be fixed, for instance may be an integral portion of the treatment-liquid container wall.

We claim:

1. Apparatus for wet processing textile material, comprising in combination a vessel containing a bath of treatment liquid, an essentially U-shaped perforated guiding structure positioned within said vessel for guiding said web through said bath and having upwardly extending legs forming outlet and inlet portions thereof and extending at least partially above said bath, means for circulating a textile material in the form of an endless web along a closed path extending in part through said bath within said guiding structure, said means including a substantially straight jet nozzle structure extending substantially horizontally above said bath and between said outlet and inlet portions of said U-shaped guiding structure and terminating with a substantially horizontal discharge in said inlet portion and horizontally spaced from the outer wall of said inlet portion, said jet nozzle structure having an inner passage and a nozzle outlet through which said web passes in turn when the apparatus is in use, means for supplying a portion of said treatment liquid to said nozzle structure under pressure for producing a jet of said liquid drawing said web in string form through said inner passage and carrying it from said nozzle structure, a deflector surface located after said nozzle sturcture and in substantially horizontal alignment therewith for deflecting said jet and the web carried thereby before reaching the bath, said nozzle outlet and said deflector surface being substantially spaced apart to provide a horizontal space therebetween substantially free from any structure imposing any restricting or guiding action on the jet and the web carried thereby before reaching said deflector surface, said inlet portion at said termination of said jet nozzle structure having inner boundary side walls horizontally spaced apart transverse to the direction of travel of said web by a dimension exceeding the maximum width of the web to thereby permit the web to expand from a string form to a band form.

2. Apparatus according to claim 1, wherein said jet nozzle structure is located in a plane containing said legs of said U-shaped perforated guiding structure, and said nozzle outlet thereof being located closer to the leg following after said nozzle outlet in said path than to the leg preceding said nozzle.

3. Apparatus in combination according to claim 2, wherein said vessel is substantially cylindric and encloses said closed path in its entirety with the cylinder axis extending transversely to said plane including said jet nozzle structure and said legs, the curvature of said U-shaped guiding structure conforming closely to the curvature of the cylinder.

4. Apparatus in combination according to claim 2, wherein said deflector surface forms an upper portion of an outer boundary wall of said leg following after said nozzle outlet, said upper portion being inclined toward said symmetry plane.

5. Apparatus in combination according to claim 1, comprising at least one guide roller rotatable about a horizontal axis for advancing the web towards an inlet of the nozzle for creasing the web edgewise into string form.

6. Apparatus in combination according to claim 5, comprising means for positively driving said guide roller at a controllable peripheral speed such as to cause the textile web to enter the driving nozzle in a tensioned condition.

7. Apparatus in combination according to claim 1, wherein said deflector surface is perforated within its region of impingement for the liquid jet and the textile string carried thereby.

8. Apparatus for wet processing textile material comprising a cylindrical vessel containing a bath of treatment liquid, an essentially U-shaped perforated guiding structure positioned within said vessel for guiding said web through said bath and having upwardly extending legs forming outlet and inlet portions thereof, the profile of the U-shape of said guiding structure being arranged perpendicular to the axis of the cylinder of said cylindrical vessel, said U-shaped guiding structure being defined by a radial outer wall and a radial inner wall and having portions of said outer wall and inner wall extending upwardly above the normal level of said treatment liquid and defining said outlet and inlet portions, the inner dimensions of said U-shaped guiding structure being substantially open and large enough in relation to the web of textile material so as to permit the textile material to be completely unfolded transverse to the web length, means for circulating said textile material in the form of an endless web through said U-shaped guiding structure within said vessel, said circulating means including a substantially straight jet nozzle structure extending substantially horizontally above said bath and between said outlet and inlet portions of said U-shaped guiding structure and terminating with a substantially horizontal discharge in said inlet portion and horizontally spaced by a substantial dimension from said outer wall of said inlet portion, said inlet portion at said termination of said jet nozzle structure having inner boundary side walls horizontally spaced apart transverse to the direction of travel of said web by a dimension exceeding the maximum width of the web, said jet nozzle structure comprising an inner passage and a nozzle outlet through which said web passes when the apparatus is in use, means for supplying a portion of said treatment liquid to said nozzle under pressure for producing a jet of said liquid and drawing said web in string form through said passage and carrying it from the outlet portion of said U-shaped guiding structure to the inlet portion of said U-shaped guiding structure.

9. Apparatus as claimed in claim 8 wherein said nozzle is operable to project said jet of liquid so as to carry the textile web across the space between the termination of said jet nozzle structure and said outer wall of said inlet portion so as to cause said jet to spread out the textile web laterally.

10. Apparatus as claimed in claim 9 wherein a deflector surface is positioned at said outer wall portion of said inlet portion of said U-shaped guiding structure and arranged in substantially horizontal alignment with said jet nozzle so as to intercept the liquid from said jet and the textile web carried by said jet across the space between said inner wall and said deflector surface and so as to cause said jet to flatten and spread out the textile web laterally to thereby convert the web from a string configuration to a band configuration.

11. Apparatus as claimed in claim 10 wherein said jet nozzle structure extends substantially horizontally above said bath and directly between said inner walls of said outlet and inlet portions of said U-shaped guiding structure and terminating at said inner walls.

* * * * *

UNITED STATES PATENT AND TRADEMARK OFFICE

CERTIFICATE OF CORRECTION

PATENT NO. : 4,142,385

DATED : March 6, 1979

INVENTOR(S) : SVEN-OLOF SANDBERG and SVEN R. E. SMITH

It is certified that error appears in the above-identified patent and that said Letters Patent are hereby corrected as shown below:

Column 4, line 17, after "cross" insert --section of--.

Column 5, line 5, "of" should read --or--.

Column 6, line 16, "sturcture" should read --structure--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*